US007419549B2

(12) United States Patent
Schwersenz et al.

(10) Patent No.: US 7,419,549 B2
(45) Date of Patent: Sep. 2, 2008

(54) NOZZLE ASSEMBLY FOR APPLYING A LIQUID TO A SUBSTRATE

(75) Inventors: Anatol Schwersenz, Mosbach (DE); Werner Saule, München (DE); Andreas Nöring, Radolfzell (DE); Peter Dress, Bruchsal (DE); Christian Bürgel, München (DE); Martin Tschinkl, München (DE); Marlene Strobl, Dresden (DE)

(73) Assignees: Steag HamaTech APE GmbH & Co. KG (DE); Infineon Technologies AG (DE)

( * ) Notice: Subject to any disclaimer, the term of this patent is extended or adjusted under 35 U.S.C. 154(b) by 473 days.

(21) Appl. No.: 10/522,563

(22) PCT Filed: Jul. 10, 2003

(86) PCT No.: PCT/EP03/07494

§ 371 (c)(1),
(2), (4) Date: Apr. 20, 2005

(87) PCT Pub. No.: WO2004/010220

PCT Pub. Date: Jan. 29, 2004

(65) Prior Publication Data

US 2005/0220931 A1 Oct. 6, 2005

(30) Foreign Application Priority Data

Jul. 19, 2002 (DE) ..... 102 32 984

(51) Int. Cl.
*B05C 3/02* (2006.01)

(52) U.S. Cl. ..... 118/413; 118/411

(58) Field of Classification Search ..... 118/410, 118/411, 413, 325, DIG. 4, 419, 420, 261; 427/402, 420; 425/569, 570
See application file for complete search history.

(56) References Cited

U.S. PATENT DOCUMENTS

| | | | | |
|---|---|---|---|---|
| 5,914,155 | A | 6/1999 | Kurtz | |
| 6,364,547 | B1 | 4/2002 | Matsuyama et al. | |
| 6,471,775 | B1 | 10/2002 | Becker et al. | |
| 2005/0066889 | A1 * | 3/2005 | Rantanen | 118/300 |

FOREIGN PATENT DOCUMENTS

| | | |
|---|---|---|
| DE | 39 32 779 | 4/1991 |
| EP | 0 366 962 | 5/1990 |
| GB | 1 500 060 | 2/1978 |
| GB | 2 127 326 | 4/1984 |
| JP | 10270336 | 10/1998 |

* cited by examiner

*Primary Examiner*—Yewebdar T Tadesse
(74) *Attorney, Agent, or Firm*—Robert W. Becker; Robert W. Becker & Assoc

(57) ABSTRACT

The aim of the invention is to achieve a rapid, homogeneous application of a liquid with as little force as possible to a substrate. To achieve this, the invention provides a nozzle assembly (22) for applying a liquid to a substrate, said assembly having a nozzle body (26) comprising a plurality of nozzles (36) that are substantially arranged in a line and a guide plate (28) that extends essentially in a vertical direction with a straight lower edge. According to the invention, the nozzles (36) above the lower edge are directed towards the guide plate (28) in such a way that a film of liquid forms on the guide plate (28) and flows over the lower edge (64).

24 Claims, 4 Drawing Sheets

NOZZLE ASSEMBLY FOR APPLYING A LIQUID TO A SUBSTRATE

BACKGROUND OF THE INVENTION

The present invention relates to a nozzle assembly for applying a liquid to a substrate.

In many fields of application, especially those for producing wafers and masks during the treatment of a substrate, it is necessary to deposit a layer of liquid such as a developer for example, on the wafer or the mask.

In the past, this has been done using a single nozzle which was directed towards the substrate and was swept or scanned over the mask or the wafer in raster-like manner in order to wet the entire surface of the substrate. As an alternative, consideration has also been given to the use of several mutually adjacent nozzles which were directed towards the surface of the substrate and wetted the entire substrate in the course of a single sweep.

If the liquid being applied is, for example, a liquid developer which is used for the development steps in a microlithographic process, it is important for the quality of the final product to ensure that the same process progress is reached—i.e. that there is a uniform degree of development—over each sub-area of the surface of the substrate being treated. The rate at which the process progresses is basically determined by the quantity of developer applied, the dwell time on the substrate and the mechanical force with which the liquid is applied to the surface of the substrate. Consequently, it is necessary for the developer to be applied simultaneously over the entire surface of the substrate in as force-free and homogeneous a manner as possible in order to ensure that the process progresses at as homogeneous a rate as possible.

In order to ensure that the liquid is applied as simultaneously as possible when applying it through a single nozzle, the nozzle should have a very high scanning speed, and a very high flow speed for the medium should be selected since large temporal inhomogeneities in the application of the medium would otherwise arise. However, the high speed of flow leads to a large mechanical deposition force during the application of the medium, this being something which should be avoided. Moreover, when using a single nozzle, a pattern corresponding to the pattern of the nozzle develops on the surface of the substrate because the medium is not usually applied evenly over the width of the area being supplied by the nozzle—both in regard to the force of application and the quantity of liquid applied.

When using a plurality of mutually adjacent nozzles, the application time can be substantially reduced as compared with a single nozzle, whereby the temporal inhomogeneity can be reduced when the medium is applied in this manner. However, it is still necessary to use high speeds of flow in order to enable the medium to be applied as simultaneously as possible, this thereby again resulting in a large mechanical deposition force during the application of the medium. Moreover, the development of a pattern described above still occurs for the individual nozzles.

Furthermore, a slot nozzle for applying a liquid high-polymer material is known from EP 03 66 962 A2. The slot nozzle consists of a two-piece nozzle body, whereby a first part incorporates a feed channel and several stop valves which are able to open and close a connection between the feed channel and corresponding outlet bores in the first part. Each of the outlet bores extends towards the second part of the nozzle body and is directed towards an elongated spreading chamber which is in the form of a recess in the second part. An outlet slot is formed between the two parts below the spreading chamber.

Based upon the above state of the art, the object of the present invention is to provide a device which enables rapid, homogeneous application of a liquid to a substrate in as force-free a manner as possible.

SUMMARY OF THE INVENTION

In accordance with the invention, this object is achieved in the case of a nozzle assembly for applying a liquid to a substrate in that the nozzle assembly comprises a nozzle body incorporating a plurality of nozzles located substantially in a line and a substantially vertically extending deflection or guide plate having a flat surface and a straight lower edge, wherein the nozzles are directed towards the flat surface of the guide plate above the lower edge so that a liquid film forms on the guide plate and flows off over the lower edge. In the case of a device constructed in this manner, a substantially homogeneous liquid film can be formed on the guide plate, and can be applied as a homogeneous film to the substrate which is to be wetted. Furthermore, the film can be applied to the surface of the substrate with a uniform force of application since the development of a pattern produced by individual nozzles no longer occurs on the surface of the substrate. Moreover, the liquid film can be applied quickly by means of a single relative movement between the substrate and the device. Although high liquid flow speeds must also be used here, the component of force effective on the surface of the substrate does not thereby increase, or at least, not substantially so. The mechanical force of application is substantially independent of the speed of flow through the nozzles and is essentially determined by the flow path over the guide plate and the height of the drop between the lower edge of the guide plate and the surface of the substrate.

In a particularly preferred embodiment of the invention, a downwardly widening gap is formed between the nozzle body and the guide plate, this thereby assisting the formation of a homogeneous liquid film on the guide plate in a direction towards the lower edge. In order to simplify the construction of the gap, the latter is preferably formed by a flat surface of the nozzle body and a flat surface of the guide plate which form an acute angle therebetween.

In order to enable the device to be used for various liquids having differing viscosities, the angle is preferably adjustable. The formation of a homogeneous liquid film in dependence on the liquid can thereby be achieved. The angle is preferably between 0.5° and 4°. Good results can also be achieved, in particular, in an angular range of between 1° and 3°, or between 1.5° and 2.5°.

In one embodiment of the invention, the flat surface of the guide plate extends downwardly over the entire flat surface of the nozzle body. It is thereby ensured that the liquid film will peel-off cleanly from the lower edge of the guide plate and that this break-away process will not be affected by the nozzle body.

In order to simplify the construction of the device, the guide plate is attached directly to the nozzle body. In particular, this thereby enables the guide plate and the nozzle body to be moved as a unit. Hereby, the guide plate is preferably attached to the nozzle body above the nozzles in order to avoid having attachment elements in the space below the nozzles which could affect the homogeneity of the liquid film on the guide plate.

In order to prevent the liquid issuing from the nozzles moving upwardly between the guide plate and the nozzle body and thus possibly impairing the homogeneity of the liquid film, provision is preferably made for a seal to be located above the nozzles between the nozzle body and the guide plate. Preferably, a recess is provided in the nozzle body, said recess having a complementary shape to that of the seal. A secure arrangement and adequate retention of the seal are thereby ensured. Preferably, the seal has a round cross section.

In accordance with a particularly preferred embodiment of the invention, the nozzles are formed by straight passages in the nozzle body, whereby, in terms of height, the inlet ends of the passages lie below the outlet ends thereof. This arrangement thus prevents liquid from dripping from the nozzles and thereby producing bubbles in the liquid system when the device is not in operation i.e. when there is no flow of liquid. Such bubbles would adversely affect the process of continuously and completely wetting the surface of the substrate. Preferably, the inlet ends of the nozzles flow into a common distributor line which has a substantially larger cross section than the respective nozzles. A substantially uniform speed of flow through all the nozzles is thereby ensured.

In order to prevent a build-up of fluid pressure on the nozzles when the system is switched-off which could lead to an outflow of liquid, the inlet ends of the nozzles are located at or in the proximity of the highest point of the distributor line.

In order to produce as homogeneous a pressure distribution as possible within the distributor line, provision is preferably made in a preferred embodiment of the invention for a supply line to lie below the distributor line and be connected to the distributor line by a plurality of feeder lines. The provision of the plurality of feeder lines enables a homogeneous pressure distribution to be obtained within the distributor line and thus a homogeneous distribution of pressure over all the nozzles. Due to the fact that the supply line lies below the distributor line, it is also ensured that no pressure will be exerted on the liquid in the nozzles when the system is switched off. Moreover, the construction of the liquid system consisting of the supply line, the distributor line and the inclined nozzles enables air to be automatically evacuated from the system when it is being filled against the force of gravity. Moreover, the emergence of liquid from the nozzles can only be effected against the effect of the force of gravity and is thus virtually impossible. A homogeneous liquid film can thereby be produced again immediately after a restart when the liquid system has been switched off for a long period of time because the liquid system is always uniformly filled with liquid and bubbles cannot occur therein.

For the purposes of obtaining a uniform distribution of pressure within the distributor line, the feeder lines between the supply line and the distributor line are preferably evenly spaced over the entire length of the distributor line.

In order to assist the homogeneous formation of the liquid film on the guide plate, at least the surface of the guide plate directed toward the nozzles is preferably made of a hydrophilic material.

In order to enable complete wetting of the surface of a substrate, a mechanism for producing a relative movement between the substrate and the guide plate is preferably provided. Hereby, the mechanism preferably comprises a unit for moving the guide plate substantially parallel to the surface of the substrate so as to provide a uniform mechanical force of application over the entire substrate.

In one embodiment of the invention, the mechanism is a linear-movement unit for moving the substrate and/or the nozzle body with the guide plate. In an alternative embodiment, the nozzle body and the guide plate are attached to a pivotal arm, whereby the maximum possible pivotal radius is selected in order to prevent the occurrence of inhomogeneities due to the pivotal movement.

In order to ensure adequate and uniform wetting of the substrate, the guide plate is preferably wider than the substrate. This is of particular advantage since the liquid film comprises inhomogeneities in the boundary regions of the guide plate.

In order to form a homogeneous liquid film corresponding to the width of the substrate, the outermost nozzles in the nozzle body are preferably spaced by a distance which is greater than the width of the substrate.

In a preferred embodiment of the invention, a mechanism is provided for adjusting the spacing between the lower edge of the guide plate and the substrate. The head or height of fall of the liquid film can thereby be changed in order to adjust the force with which the liquid is applied to the substrate. In a further embodiment of the invention, the lower edge of the guide plate is a sharp edge in order to provide a defined break-away edge at the lower edge of the guide plate. This thereby ensures that the liquid film will run-off in a defined manner and, moreover, a change in the direction of flow of the liquid when leaving the guide plate is prevented.

In order to adjust the width of the liquid film in dependence on the substrates which are to be wetted, provision is preferably made for a mechanism for opening and closing predetermined nozzles, and in particular, the outermost nozzles.

For the purposes of producing a homogeneous liquid film, an angle within the range of 90° to 94° is formed between the nozzles and the guide plate. Good process results can be obtained, in particular, in an angular range of between 90.5° and 93° or between 90.5° and 92°.

The device in accordance with the invention is particularly suitable for use in the field of wafer and mask production wherein very fine structures have to be processed and wherein extremely homogeneous process conditions must prevail.

BRIEF DESCRIPTION OF THE DRAWINGS

The invention is described in more detail hereinafter with the aid of a preferred exemplary embodiment taken in conjunction with the drawings. Therein.

DESCRIPTION OF SPECIFIC EMBODIMENTS

Figure 1:
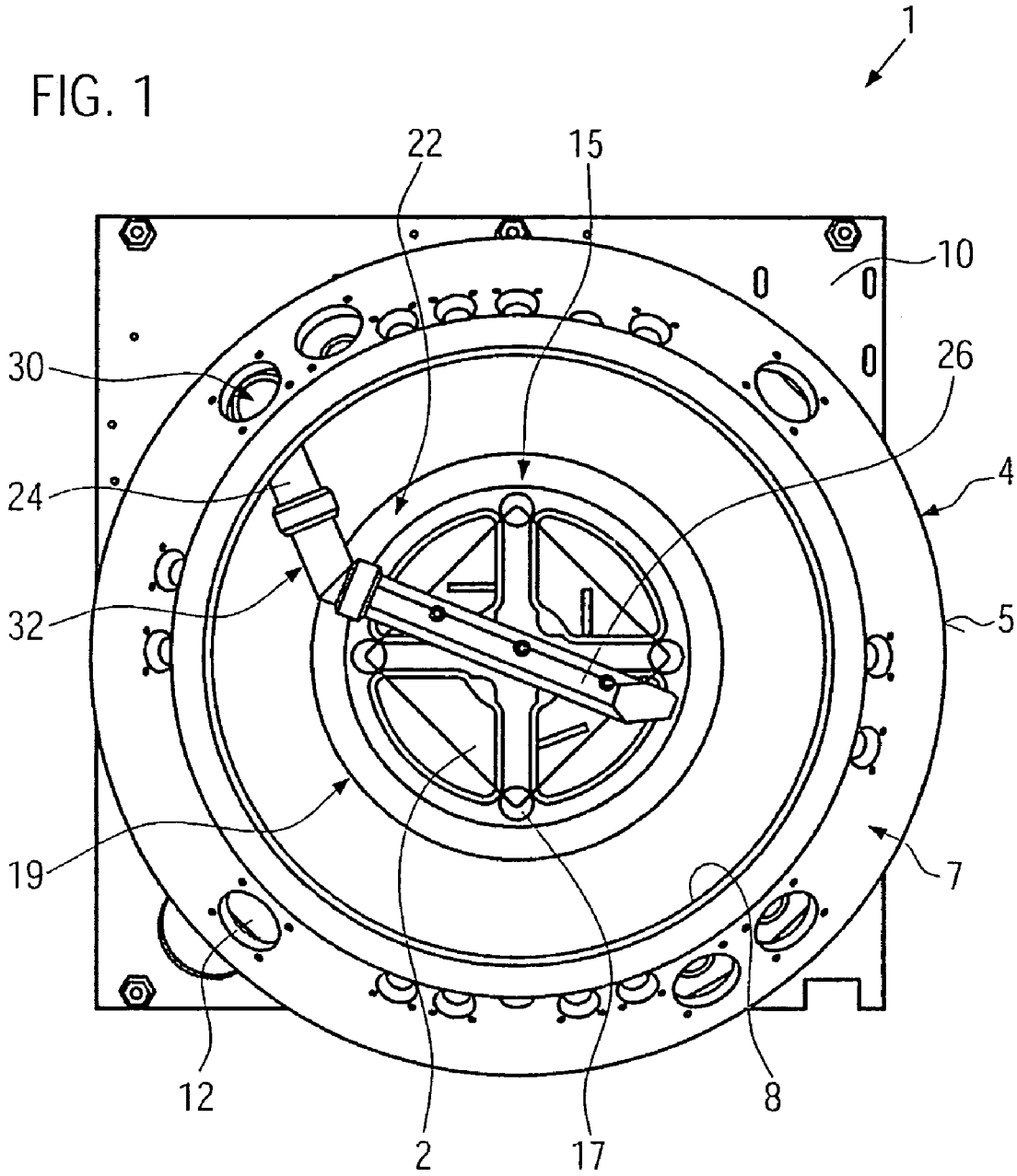
FIG. 1 shows a schematic plan view of a device for treating masks in the production of wafers which comprises a nozzle assembly in accordance with the present invention.

FIG. 1 shows a schematic plan view of a device 1 for treating masks 2 used for the production of semiconductor wafers. The device 1 includes a treatment container 4 having a side wall 5 which is conically tapered at least in an upper portion 7 thereof and thereby forms an upper, round input/output opening 8. The base of the treatment container 4 is formed by an appropriate base plate which is fixed together with the side wall 5 to a mounting plate 10. The upper input/output opening 8 is adapted to be closed by an appropriate cover which is not illustrated in detail. A plurality of through holes 12 providing a feed passage for different treatment systems, in particular feed lines for different liquids, is provided in the conical part 7 of the side wall 5.

A rotatable receiver or seating mechanism 15 is provided inside the treatment container 4, said mechanism comprising four receiver or seating elements 17 in accordance with FIG. 1. The seating mechanism 15 is rotatable by means of a shaft extending through the bottom wall of the container and a suitable drive. The seating mechanism 15 is dynamically balanced in such a manner as to make high numbers of revolutions possible.

Below the seating mechanism 15, there is provided a sealing bellows 19 which seals the shaft of the seating mechanism 15 with respect to the processing environment. Apart from its sealing function, the bellows, which may be in the form of a blacksmiths bellows for example, also serves for displacing the seating mechanism perpendicularly relative to the plane of the drawing of FIG. 1. Naturally, this function could also be provided by any other suitable device.

Furthermore, a nozzle assembly 22 in accordance with the invention can be perceived in FIG. 1, this assembly being arranged partly above the mask 2 in the illustration of FIG. 1.

Figure 4:
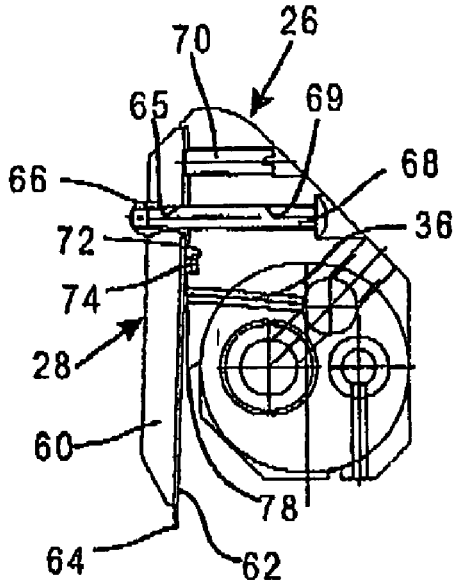
FIG. 4 a schematic side view of a nozzle assembly in accordance with the present invention.

The nozzle assembly 22 consists of an inlet line 24, a nozzle body 26 and a deflector or guide plate 28 which is not visible in FIG. 1 but can best be seen in FIG. 4.

The inlet line 24 incorporates a tubing section 30 which extends substantially perpendicularly relative to the plane of the drawing of FIG. 1 and is connected to a swivelling mechanism in an appropriate manner for the purposes of pivoting the inlet line 24 about a pivotal axis extending perpendicularly to the plane of the drawing in the vicinity of the section 30. Furthermore, the inlet line 24 includes a section which forms an extension arm 32 that extends substantially in the plane of the drawing in accordance with FIG. 1. The nozzle body 26 is mounted on the free end of the extension arm 32 in an appropriate manner. The nozzle body 26 is formed by a straight elongated body which extends at an angle with respect to the main direction of extent of the extension arm 32. Due to the fact that the inlet line 24 is pivotal in the vicinity of the section 30, the nozzle body 26 can be pivoted from a region within which it is not arranged above the mask 2 into a region where it is above the mask and is pivotal over the entire mask. The angle between the main direction of extent of the extension arm 32 and the nozzle body 26 thereby results in a larger pivotal range. This enables the mask 2 to be lifted out of the treatment container 4 in a direction perpendicular to the direction extending in the plane of the drawing of FIG. 1. This is necessary so as to give an external handling robot access to the mask 2 in order to remove it from the seating mechanism 15 or to deposit a new mask thereon.

Furthermore, the pivotal movement of the nozzle body 26 enables the mask 2 to be wetted in its entirety as will be described in more detail hereinafter.

Figure 2:
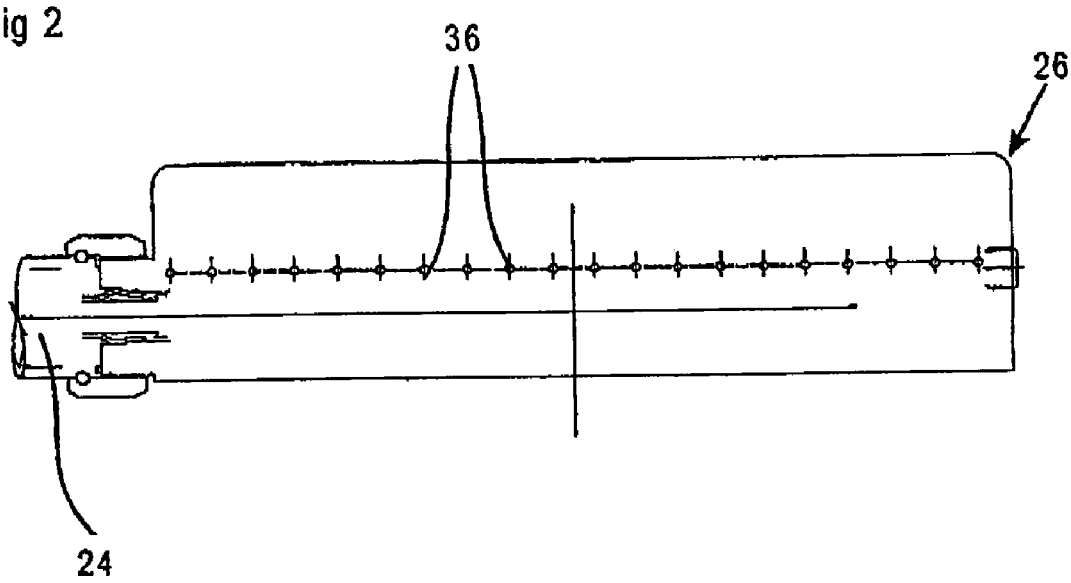
FIG. 2 a schematic front view of a nozzle body in accordance with the present invention.
Figure 3:
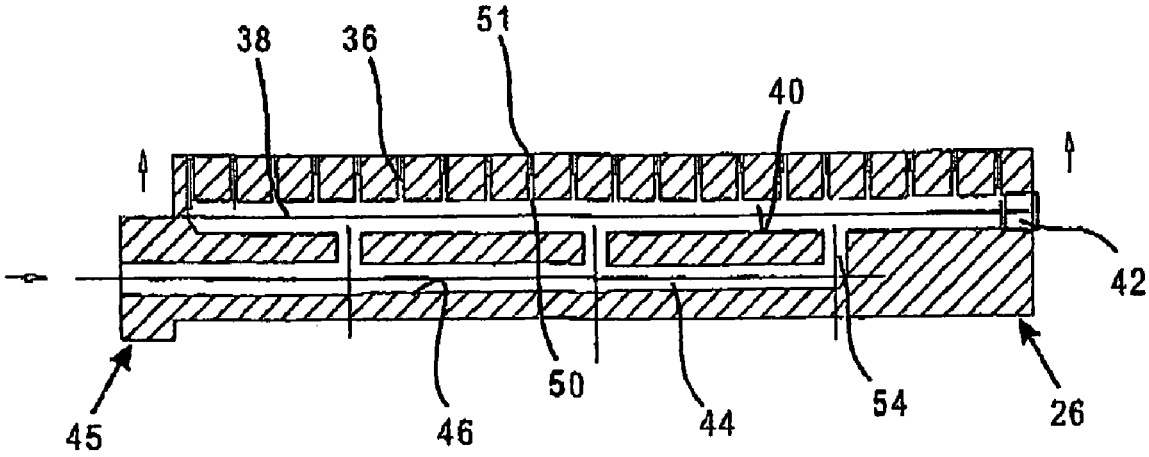
FIG. 3 a schematic sectional view through the nozzle body in accordance with FIG. 2.

FIG. 2 shows a schematic front view of the nozzle body 26 without the guide plate 28 and FIG. 3 shows a schematic sectional view through the nozzle body 26, likewise without the guide plate 28 attached thereto. As can be perceived from FIGS. 2 and 3, a total of 20 nozzles 36 are provided in the nozzle body 26, said nozzles being disposed in a straight line. The nozzles 36 are each formed by corresponding straight bores in the nozzle body 26. The nozzles 36 are connected to a distributor line 38 which extends perpendicularly relative to the nozzles 36 and is formed by a straight blind bore 40 in the nozzle body 26. The blind bore 40 extends into the nozzle body 26 from the end thereof remote from the inlet line 24. The open end of the blind bore 40 is closed by a suitable plug 42.

Alternatively, the bore 40 could also extend completely through the nozzle body 26 and the respective opposite openings could be closed in an appropriate manner. For example, each of the opposite ends could be closed by a slider which enables a connection between the distributor line 38 and the outermost nozzles 36 to be blocked in order to thereby gradually reduce the number of nozzles 36 supplied with the liquid. Such a decrease in the number of operable nozzles can be effected from one side in the case of the blind bore or from both sides in the case of a through-bore in order to obtain a more symmetrical arrangement.

Furthermore, a supply line 44 is provided in the nozzle body 26, this line being formed by an appropriate blind bore 46. Although this is not perceptible in FIG. 3, the supply line 44 is, in terms of height, below the distributor line 38. Moreover, the nozzles 36 are connected to the distributor line at or in the proximity of the highest point thereof. Furthermore, in the case of a normal alignment of the nozzle body 26, the nozzles 36 rise with respect to the horizontal, i.e. they have an inlet end 50 which communicates with the distributor line 38 and lies at a lower level relative to the outlet end 51 thereof. These characteristics of the geometrical arrangement of the supply line 44, the distributor line 38 and the nozzles 36 are also basically apparent from the schematic side view in accordance with FIG. 4 or the schematic partial sectional view in accordance with FIG. 5.

The supply line 44 is connected by suitable feeder lines 54 to the distributor line 38. The feeder lines 54 are evenly spaced with respect to the length of the distributor line 38 and are arranged symmetrically with respect to a centre plane in order to make the pressure distribution within the distributor line 38 as uniform as possible.

Instead of providing the supply line 44 extending laterally into the nozzle body 26 in the form of a blind bore with a lateral end connector 45, it is also possible to provide the nozzle body 26 with a substantially central connector in order to produce a better distribution of pressure within the supply line 44 and consequentially within the distributor line 38. Furthermore, the use of a central connection of the inlet line 24 to the nozzle body 26 would increase the pivotal radius.

Figure 5:
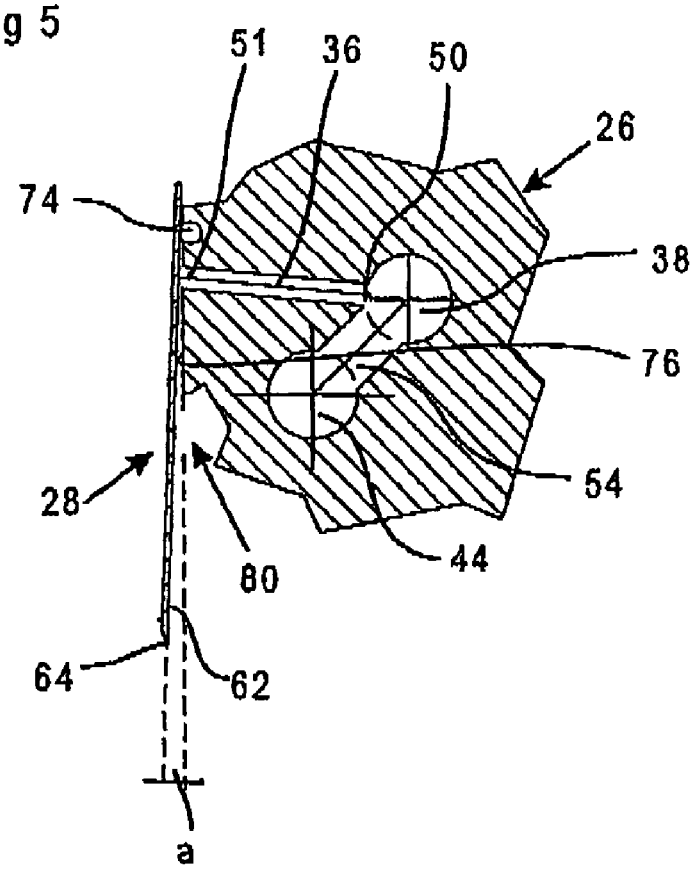
FIG. 5 a schematic partial sectional view through a nozzle assembly in accordance with the present invention.
Figure 6:
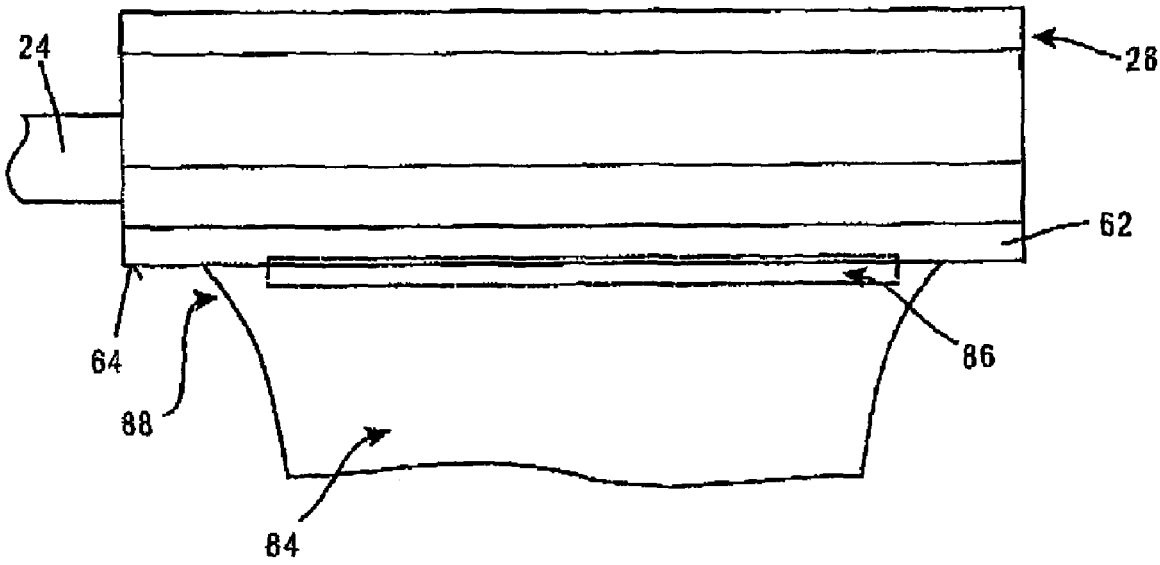
FIG. 6 a schematic front view of a nozzle assembly in accordance with the invention.

FIGS. 4 and 5 respectively show a schematic side view of a nozzle body 26 and a guide plate 28 attached thereto, and a schematic partial sectional view through the nozzle body 26 and the guide plate 28. FIG. 6 shows a schematic front view of the guide plate 28 and the nozzle body 26.

As can best be perceived from FIG. 4, the guide plate 28 comprises a trapezoidal base plate 60 whose longer side faces toward the nozzle body 26. The longer side is partly provided with a layer 62 of hydrophobic material, whereby the layer 62 extends beyond the lower end of the base body 60 and ends in a sharp edge 64.

The base body 60 comprises a through-bore 65 which extends perpendicularly relative to the main sides and has a semicircular recess for accommodating a ball nut 66 at the end thereof remote from the nozzle body 26. A bolt 68 extends through the bore 65 in the nozzle body 60 and a corresponding bore 69 in the nozzle body 26 and is screwed into the ball nut 66. The guide plate 28 is held on the nozzle body 26 thereby. The guide plate 28 is hereby pivotal about the ball nut 66 to a small extent. The degree to which pivotal movement can occur is basically limited by the play of the bolt 68 in the through-bore in the base body 60. The degree of pivotal movement is adjusted by means of a set screw 70 within the nozzle body 26. Naturally, although only one fixing bolt 68 and one set screw 70 are illustrated in FIG. 4, a plurality of fixing bolts and/or set screws can be provided over the whole width of the guide plate 28.

As can be seen in FIG. 4, the fixing bolts 68 and set screws 70 are located above the nozzles 36 and above the hydrophobic layer 62. The hydrophobic layer 62 extends downwardly from the through-bore in the base body 60, but naturally, it could also extend above the through-bore. A dove tail groove 72 for accommodating a round sealing element 74 is provided in the nozzle body 26. The dove tail groove 72 is provided in a surface of the nozzle body 26 facing towards the guide plate 28 and, in terms of height, is located between the nozzles 36 and the bores for accommodating the fixing bolts 68. The round sealing element accommodated in the dove tail groove 72 seals with respect to the guide plate 28 and prevents the liquid flowing out of the nozzles 36 under pressure from flowing upwardly.

Below the nozzles 36, the nozzle body 26 has a flat wall 76 which extends substantially perpendicularly downwards and ends at a lower edge 78. This flat wall together with the guide plate 28 and particularly with the hydrophobic layer 62 forms a downwardly widening gap 80, as can best be seen in FIG. 5. The gap 80 forms an acute angle $\alpha$ which preferably lies between 0.5° and 4° and can be varied by the abovementioned adjusting mechanism. Hereby, the angle can preferably lie between 1° and 3° or between 1.5° and 2.5°. The widening gap enables a homogeneous liquid film to be formed in an effective manner from the liquid issuing from the nozzles 36, as will be described in more detail hereinafter.

The lower edge 78 of the straight wall 76 of the nozzle body 26 ends above the lower sharp edge 64 of the hydrophobic layer 62 in order to prevent the liquid film that was formed therebetween from running unevenly off the lower edge 64.

FIG. 6 shows a schematic view of the guide plate 28 and a liquid film 84 running off it. The nozzle body 26 is not perceptible in this view because it basically lies behind the guide plate 28. The width of the guide plate 28 and the nozzle body located behind it is greater than the width of the mask which is to be wetted although the latter is not illustrated in FIG. 6. As can be seen from FIG. 6, the liquid film 84 formed on the guide plate 28 extends over the entire width of the guide plate 28 and has a homogeneous central region 86 as well as inhomogeneous boundary regions 88, this being the result, inter alia, of the fact that each of the outer nozzles 36 in the nozzle body 26 only has one neighbouring nozzle in each case. The width of the homogeneous central region 86 of the liquid film 84 corresponds to at least the width of the mask which is to be wetted in order to ensure homogeneous coating thereof. This can be achieved by virtue of the guide plate 28 having a greater width than the mask which is to be coated and by virtue of the spacing between the outer nozzles 36 in the nozzle body 26 being greater than the width of the mask. If, as in the device illustrated in FIG. 1, the nozzle assembly 22 is pivoted over the mask 2, the length of the homogeneous central region must naturally be such as to correspond to at least the maximum covering of the mask 2, this being achievable by means of an appropriate length of the guide plate and an appropriate spacing between the outer nozzles.

The employment of the nozzle assembly in accordance with the invention will be described in more detail hereinafter with the aid of the Figures.

Firstly, the nozzle assembly 22 is moved out of the range of vertical movement of the seating mechanism 15. Subsequently, the seating mechanism 15 is raised vertically. A mask requiring processing 2 is seated on the seating elements 17 of the seating mechanism 15 by a not illustrated handling robot. The seating mechanism 15 is again moved vertically downward so that, in terms of height, it is located under the nozzle assembly 22.

A treatment liquid, such as a developer liquid for example, is introduced into the nozzle body 26 via the inlet line 24. Hereby, the liquid is introduced via the supply line 44. The liquid rises upwardly in the supply line 44 and then flows via the feeder lines 54 into the distributor line 38. The liquid thus rises against the force of gravity whereby air cavities in the respective lines are avoided. From the distributor line 38, the liquid enters the nozzles 36, whereby the nozzles 36 are filled from the bottom up due to the upward gradient of the nozzles 36. Again, air cavities in the liquid are thereby avoided. Moreover, air cavities are prevented by virtue of the fact that the liquid is introduced into the nozzle body 26 at high pressure. When the liquid issues from the outlet ends 51 of the nozzles 36, it impinges on the guide plate 28, and in particular, the hydrophilic layer 62. Due to the pressure, the liquid spreads laterally and downwardly along the guide plate 28. Upward propagation thereof is prevented by the seal 74. A homogeneous liquid film is thereby formed on the hydrophobic layer 62, this film then flowing off downwardly. The homogeneity of the forming liquid layer is assisted by the downwardly widening gap 80 which also contributes to a calming of the current flow.

When the downwardly flowing liquid film 84 has formed, the nozzle assembly 22 is pivoted by means of the not illustrated pivotal device in such a manner that the nozzle body sweeps over the entire mask 2 at a uniform speed. The downwardly flowing liquid film 84 thereby forms a homogeneous liquid layer on the mask 2.

Prior to the sweep of the nozzle assembly over the mask 2, the distance between the lower edge 64 of the hydrophobic layer 62 and the top face of the mask 2 is adjusted by means of the bellows 19. This distance can be made very small in order to keep the mechanical force with which the liquid film 84 is applied to the surface of the mask very low. The speed of flow of the liquid in the nozzle assembly 22 and hence the speed of flow of the liquid film 84, as well as the speed of the pivotal movement are selected in such a manner that a liquid layer having a suitable layer thickness is formed on the mask 2.

After the sweep of the nozzle assembly 22 over the mask 2, the flow of liquid into the nozzle assembly 22 is switched off and the nozzle assembly 22 is pivoted back into its starting position, i.e. outside the range of vertical movement of the seating mechanism 15. Since the nozzle assembly 22 is filled against the force of gravity, there is no fear of liquid flowing out inadvertently after the stream of liquid has been switched off so that the nozzle assembly 22 can be pivoted back safely.

Subsequently, the mask 2 is further processed in known manner. Finally, the mask 2 is removed from the device 1.

The invention has been described hereinabove with the aid of a preferred exemplary embodiment of the invention, without being limited to the concretely illustrated exemplary embodiment. For example, the nozzle assembly in accordance with the invention is also suitable for the wetting of semiconductor wafers or any other types of substrates. In particular, the application of a wetting liquid in as force-free a manner as possible is also necessary for semiconductor wafers since the components formed thereon which have dimensions in the nanometer range can easily be destroyed. Furthermore, the provision of a hydrophobic layer 62 on the guide plate 28 is not absolutely necessarily. Rathermore, the guide plate 28 could be formed by a base body 60 alone.

The specification incorporates by reference the disclosure of German priority document 10232984.2 filed Jul. 19, 2002 and PCT/EP2003/007494 filed Jul. 10, 2003.

The present invention is, of course, in no way restricted to the specific disclosure of the specification and drawings, but also encompasses any modifications within the scope of the appended claims.

The invention claimed is:

1. A nozzle assembly for applying a liquid to a substrate, wherein the nozzle assembly comprises a nozzle body incorporating a plurality of nozzles located substantially in a line and a substantially vertically extending guide plate having a flat surface and a straight lower edge wherein the nozzles are directed towards the flat surface of the guide plate above the lower edge so that a liquid film forms on the guide plate and flows off over the lower edge, wherein a downwardly widening gap is formed between the nozzle body and the guide plate, said widening gap being formed by a flat surface of the nozzle body and the flat surface of the guide plate which are arranged at an acute angle ($\alpha$) of between 0.5 and 4° relative to one another, and wherein the planes of the flat surfaces cross above the nozzles in the area of the nozzle body.

2. A nozzle assembly in accordance with claim 1, wherein the acute angle ($\alpha$) is adjustable.

3. A nozzle assembly in accordance with claim 1, wherein the acute angle ($\alpha$) lies between 1° and 3°, and more preferably between 1.5° and 2.5°.

4. A nozzle assembly in accordance with claim 1, wherein the flat surface of the guide plate extends downwardly over the entire flat surface of the nozzle body.

5. A nozzle assembly in accordance with claim 1, wherein the guide plate is attached directly to the nozzle body, or wherein the guide plate is attached to the nozzle body above the nozzles.

6. A nozzle assembly in accordance with claim 1, wherein a seal is located above the nozzles between the nozzle body and the guide plate.

7. A nozzle assembly in accordance with claim 6, wherein a recess is provided in the nozzle body for accommodating the seal.

8. A nozzle assembly in accordance with claim 7, wherein the inlet ends of the nozzles flow into a common distributor line which has a substantially larger cross section than the respective nozzles.

9. A nozzle assembly in accordance with claim 8, wherein the inlet ends of the nozzles lie at or in the proximity of a highest point of the distributor line.

10. A nozzle assembly in accordance with claims 8, wherein a supply line is located below the distributor line and is connected by a plurality of feeder lines to the distributor line.

11. A nozzle assembly in accordance with claim 10 wherein the feeder lines are evenly spaced over the entire length of the distributor line.

12. A nozzle assembly in accordance with claim 6, wherein the seal has a round cross section.

13. A nozzle assembly in accordance with claim 1, wherein the nozzles are formed by straight passages in the nozzle body and whereby, in terms of height, an inlet end of the passage lies below an outlet end.

14. A nozzle assembly in accordance with claim 1, wherein at least one surface of the guide plate directed toward the nozzles consists of a hydrophilic layer.

15. A nozzle assembly in accordance with claim 1, wherein a mechanism is provided for producing a relative movement between the substrate (2) and the nozzle assembly.

16. A nozzle assembly in accordance with claim 15, wherein the mechanism comprises a unit for moving the nozzle assembly substantially parallel to the surface of the substrate, or a linear-movement unit for moving the substrate and/or the nozzle assembly.

17. A nozzle assembly in accordance with claim 16, wherein the nozzle body and the guide plate are attached to a pivotal arm.

18. A nozzle assembly in accordance with claim 1, wherein the guide plate is wider than the substrate.

19. A nozzle assembly in accordance with claim 1, wherein the outermost nozzles along the line are spaced by a distance which is greater than the width of the substrate.

20. A nozzle assembly in accordance with claim 1, wherein a mechanism is provided for adjusting the spacing between the lower edge of the guide plate and the substrate.

21. A nozzle assembly in accordance with claim 1, wherein the lower edge of the guide plate is a sharp edge.

22. A nozzle assembly in accordance with claim 1, wherein a mechanism is provided for opening and closing pre-determined nozzles.

23. A nozzle assembly in accordance with claim 22, wherein said mechanism is provided for opening and closing outermost ones of the nozzles.

24. A nozzle assembly in accordance with claim 1, wherein an angle within the range of 90° to 94°, and preferably between 90.5° and 93° is formed between the nozzles and the guide plate and more preferably between 90.5 and 92.

* * * * *